US006581614B1

(12) United States Patent
Gotfried

(10) Patent No.: US 6,581,614 B1
(45) **Date of Patent: *Jun. 24, 2003**

(54) WASHING AND CHILLING APPARATUS AND METHOD

(76) Inventor: Bradley L. Gotfried, 8949 SE. Bridge Rd., Hobe Sound, FL (US) 33455

( * ) Notice: Subject to any disclaimer, the term of this patent is extended or adjusted under 35 U.S.C. 154(b) by 37 days.

This patent is subject to a terminal disclaimer.

(21) Appl. No.: 09/918,620

(22) Filed: Jul. 30, 2001

Related U.S. Application Data

(63) Continuation-in-part of application No. 09/465,476, filed on Dec. 16, 1999, now Pat. No. 6,276,373.

(51) Int. Cl.[7] ..... B08B 9/00

(52) U.S. Cl. ..... 134/22.1; 134/22.18; 134/25.2; 134/37; 134/95.3; 134/105; 134/170; 134/171

(58) Field of Search ..... 134/22.1, 22.18, 134/25.2, 37, 95.3, 105, 170, 171

(56) References Cited

U.S. PATENT DOCUMENTS

| | | | | |
|---|---|---|---|---|
| 701,129 A | | 5/1902 | Belknap | |
| 1,133,088 A | | 3/1915 | Brooks | |
| 2,240,572 A | | 5/1941 | Poxon | |
| 2,671,742 A | | 3/1954 | Cozzoli | |
| 2,739,455 A | | 3/1956 | Idzi | |
| 2,786,479 A | | 3/1957 | Dungfelder et al. | |
| 3,070,104 A | | 12/1962 | Faust et al. | |
| 3,680,567 A | | 8/1972 | Hansen | |
| 3,940,944 A | | 3/1976 | Lapeyre | |
| 5,027,840 A | | 7/1991 | Nezworski | |
| 5,367,887 A | | 11/1994 | Byrd et al. | |
| 5,876,511 A | * | 3/1999 | Till | 134/22.1 |
| 6,009,889 A | * | 1/2000 | Brenkus et al. | 134/22.12 |
| 6,244,275 B1 | * | 6/2001 | Ziegler et al. | 134/18 |
| 6,276,373 B1 | * | 8/2001 | Gotfried | 134/22.1 |

* cited by examiner

*Primary Examiner*—Randy Gulakowski
*Assistant Examiner*—Saeed Chaudhry
(74) *Attorney, Agent, or Firm*—Akerman Senterfitt

(57) ABSTRACT

A method and apparatus for washing articles includes a washing compartment and a plurality of fluid outlets. A tray for retaining the articles is positionable in the washing compartment. The tray has at least one fluid directing nozzle which is alignable with the fluid outlets in the washing compartment to permit fluid to flow from the nozzles through the tray and to direct the fluid into contact with the articles.

21 Claims, 17 Drawing Sheets

CYCLE TIME SCHEDULE

| CYCLE | MAXIMUM TIME (MINUTES) | TEMPERATURE, °F |
|---|---|---|
| WASH | 1.00 | 120°F |
| SANITIZE | .50 | 75°F |
| RINSE | 1.00 | 75°F |
| FREEZE | 1.00 | < 20°F |
| TOTAL | 3.50 | |

FIG. 19

WASHING AND CHILLING APPARATUS AND METHOD

CROSS-REFERENCE TO RELATED APPLICATIONS

This application is a continuation-in-part of application Ser. No. 09/465,476 filed Dec. 16, 1999 now U.S. Pat. No. 6,276,373.

BACKGROUND OF THE INVENTION

1. Field of the Invention

This invention relates generally to washing apparatus, and more particularly to washing and chilling apparatus for glasses, dishes, medical-related products, and other articles.

2. Description of the Related Art

Restaurants, bars and other food and beverage service establishments use a number of glasses, mugs and dishes on a continual basis. These and other articles must be continuously washed for reuse. Washing is accomplished by hand or by a number of known washing apparatus. It is desirable in some instances, particularly for glasses and mugs in which beer or cocktails will be served, or bowls or other dishes in which cold desserts such as ice cream or sorbet will be served, to chill the glass or dishes so as to create a layer of frost on the outside of the glass or dish. It is desirable that such a layer of frost does not include frozen droplets of water, but rather is smooth and even. In any case, it is also desirable that glasses, dishes, and other articles washed in warm water be chilled at least to room temperature or lower, so as to not warm chilled beverages or foods which will be served therein.

Glasses and mugs used in food service establishments are commonly stored in trays which hold several glasses. Such trays can be used to store the glasses prior to washing, after washing, for storage, and the like. These trays are typically formulated from non-corrosive plastics and metals in a mesh configuration or with a plurality of drain openings to permit liquid to drain from the trays. A significant amount of time can be spent by workers placing the glasses into these trays, or taking the glasses from these trays for washing, rinsing, drying, chilling and storage. It would be desirable to provide an apparatus and method for washing and chilling a variety of articles which would reduce the amount of time that workers spend moving the articles into or out of such trays.

Apparatus for chilling articles commonly use conventional vapor compression refrigeration equipment to supply chilled air to the articles. This refrigeration equipment requires significant expenditures of energy to power the compressor. It would be desirable to provide a washer and chiller which would reduce the energy required by the apparatus to chill the articles.

The washing and chilling of articles requires that the washing, rinsing, sanitizing, and chilling fluids thoroughly contact the surface of the articles, including the interior surface of the articles. Uneven or incomplete flow results in articles which are not washed, rinsed or sanitized properly, or articles which are not chilled or frosted evenly across the surface of the articles. It would therefore be desirable to provide a washing and chilling apparatus which would provide for more even flow of washing and chilling fluids around the surfaces of the articles than is available with current apparatus.

It is also desirable to provide a washer and chiller for articles such as medical equipment, laboratory equipment (including test tubes and petri dishes), and baby formula bottles, where the item should be chilled to at least room temperature before use. Pre-chilling may be especially desirable for laboratory equipment used to freeze samples.

SUMMARY OF THE INVENTION

The invention provides a washing and chilling apparatus in which at least one tray is provided for holding a plurality of articles. Each tray has a plurality of fluid-directing openings. The trays are insertable into a washing compartment having a plurality of fluid outlets. The fluid-directing openings of the trays and the fluid outlets of the washing compartment are positioned such that, upon insertion of the tray into the fluid washing compartment, the fluid-directing openings are aligned with or otherwise placed in fluid communication with the fluid outlets of the washing compartment. The fluid is thereby directed from the washing compartment into the trays in such a manner as to thoroughly contact the surface of the articles.

The fluid-directing openings are preferably provided as fluid nozzles extending upward from the bottom of the tray. The articles may be stacked top-down with an opening of the articles over the upright nozzle. The nozzles retain the articles in place, and also direct fluid from the fluid-directing opening into contact with the interior surfaces of the articles. The nozzles are preferably substantially conical in shape, with the base of the cone provided substantially at the bottom of the tray, and the fluid-directing openings provided at the vertex of the cone. It is understood, however, that the invention is not limited to these arrangements.

The fluid outlets of the washing compartment preferably are in communication with a manifold. The manifold preferably communicates to fluid sources, and suitable structure such as a switching valve switches between the various fluid sources, depending on the cycle of the apparatus. The fluid sources preferably include a source of washing liquid, rinsing liquid, sanitizing liquid and chilling liquid. The washing liquid is preferably hot water into which a detergent is added. The rinsing liquid is preferably cold water. After a time, a sanitizing solution is preferably introduced into the cold water. Finally, a rinse of cold water, which can include a chemical rinsing agent, is utilized.

An air stream is preferably utilized to assist in dispensing the liquids through the supply outlets and fluid-directing openings into the trays. A mist eliminator can be utilized to trap liquid which is entrained in the air stream. The air stream preferably is injected by the fluid-directing openings of the tray to create a cyclonic motion of fluids around the surface of the articles. A preferred fluid velocity is at least 100 feet per second to generate a significant level of agitation which accelerates the cleaning of the items, although lower velocities are also acceptable.

Chilling of the articles is preferably accomplished by a cryogenic fluid such as a liquid gas source. This liquid gas can be directed into the washing compartment and flash to a gas. The gas can then contact the articles, causing the articles to be chilled. Liquid nitrogen is a preferred chilling fluid.

BRIEF DESCRIPTION OF THE DRAWINGS

There are shown in the drawing embodiments which are presently preferred, it being understood, however, that the invention is not limited to the precise arrangements and instrumentality shown, wherein:

FIG. 4-A is a cross section taken along line 4A—4A in FIG. 3.

FIG. 19 is a table illustrating a cycle time schedule according to the invention.

DETAILED DESCRIPTION OF THE PREFERRED EMBODIMENTS

Figure 1:
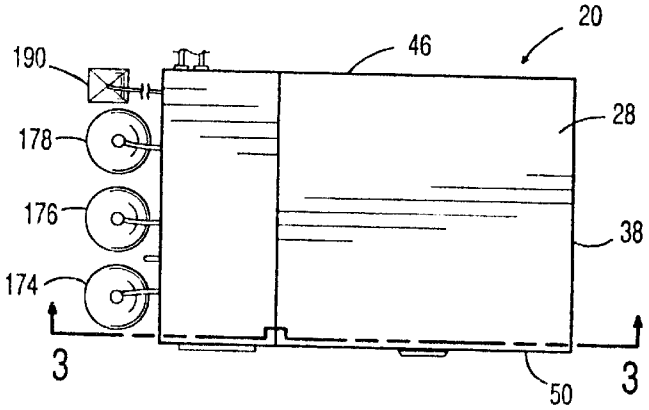
FIG. 1 is a top plan view of a washing and chilling apparatus according to the invention.
Figure 2:
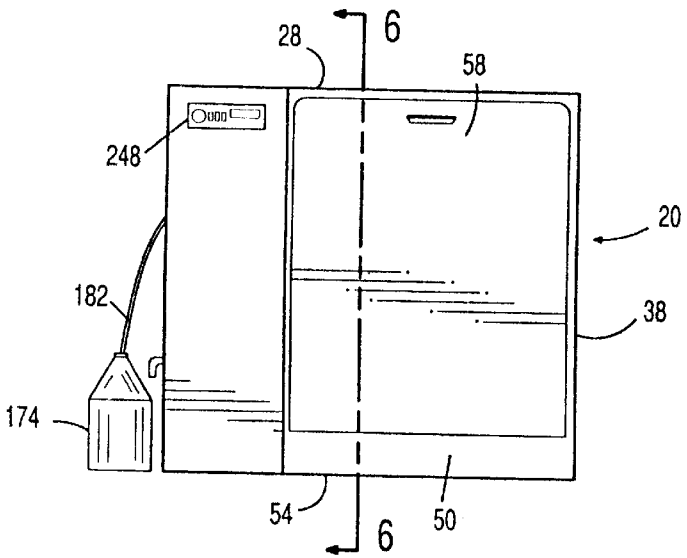
FIG. 2 is a front elevation of the apparatus of FIG. 1.
Figure 3:
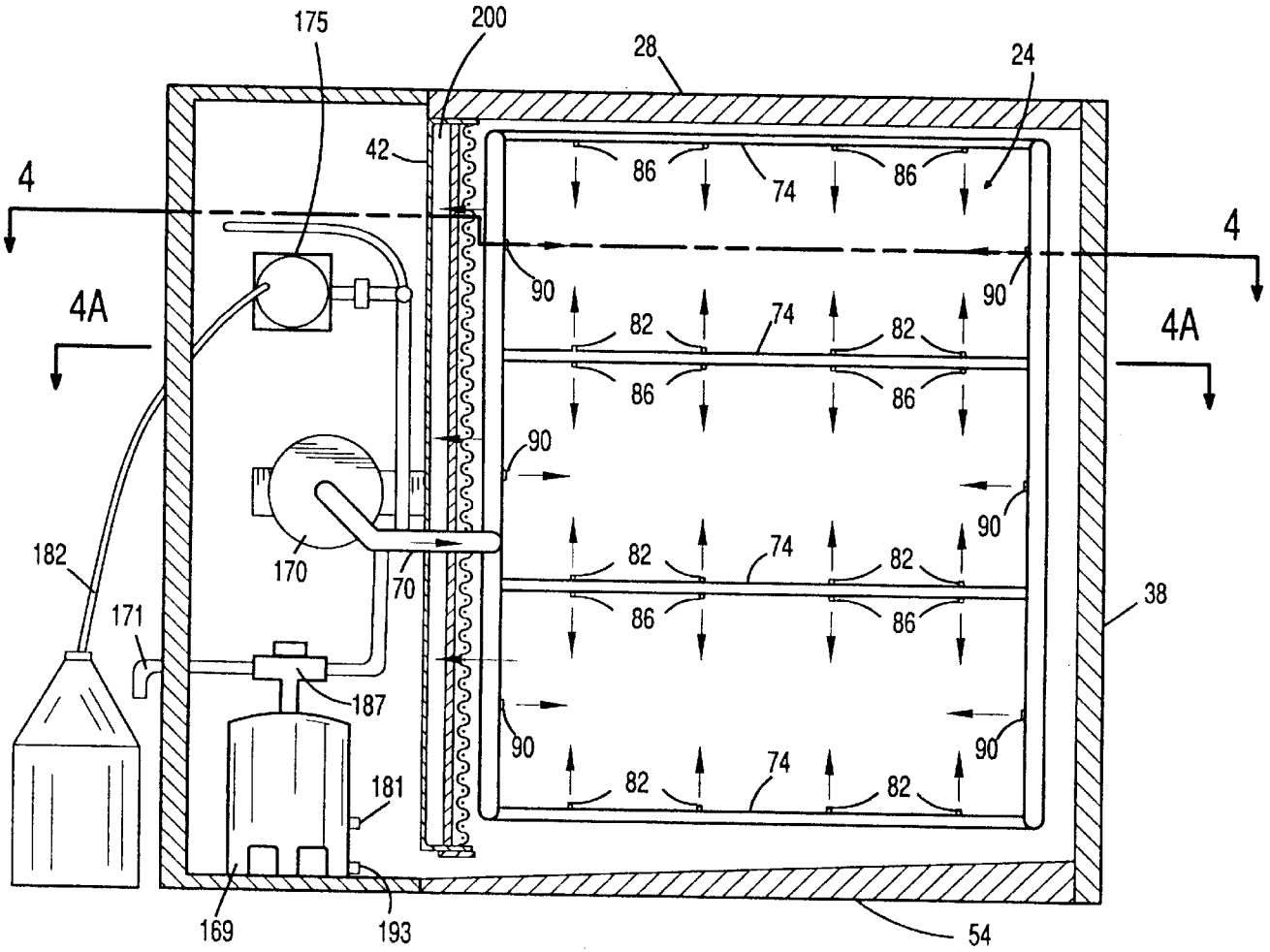
FIG. 3 is a cross section taken along line 3—3 in FIG. 1.
Figure 4:
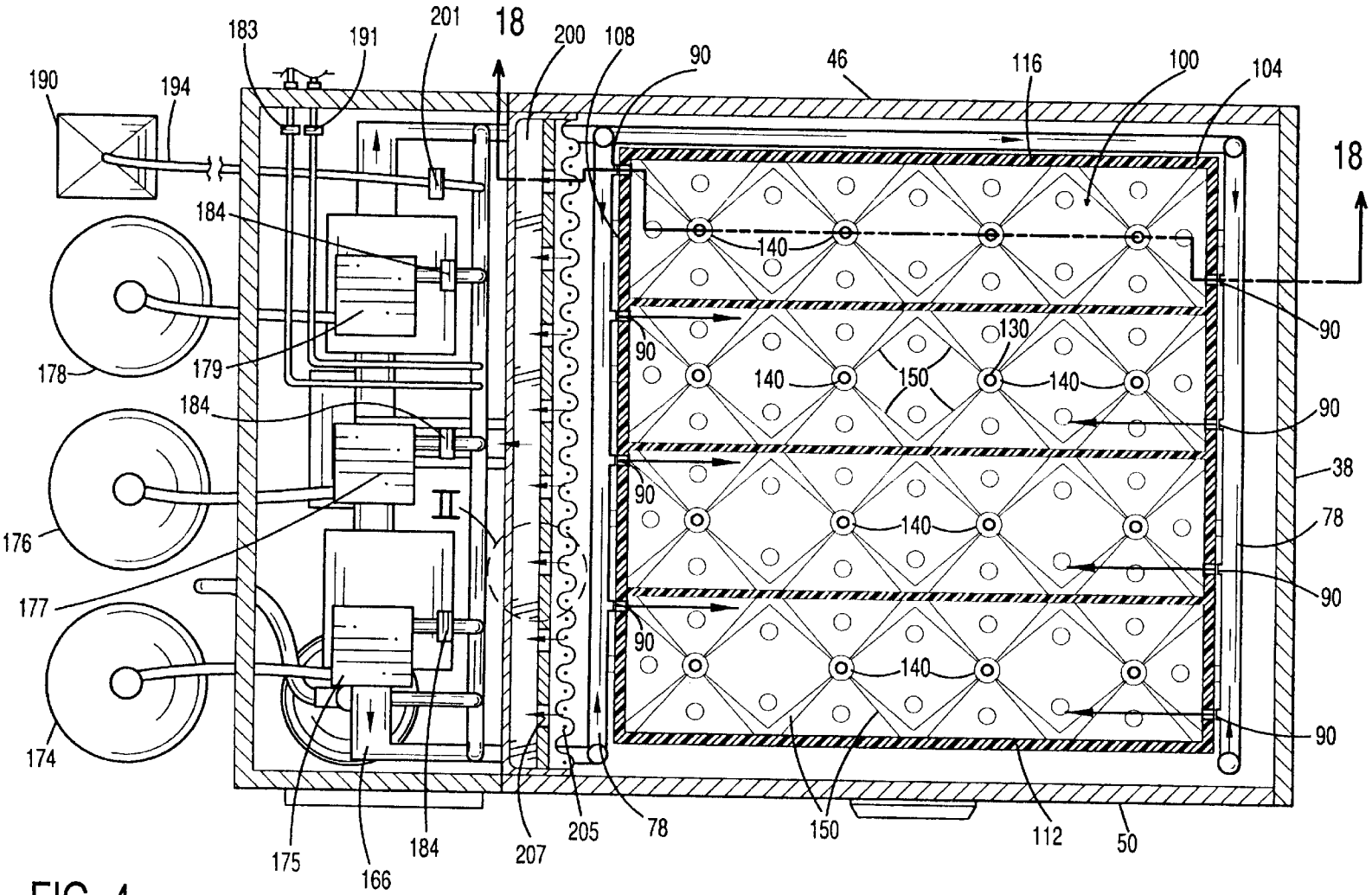
FIG. 4 is a cross section taken along line 4—4 in FIG. 3.
Figure 4A:
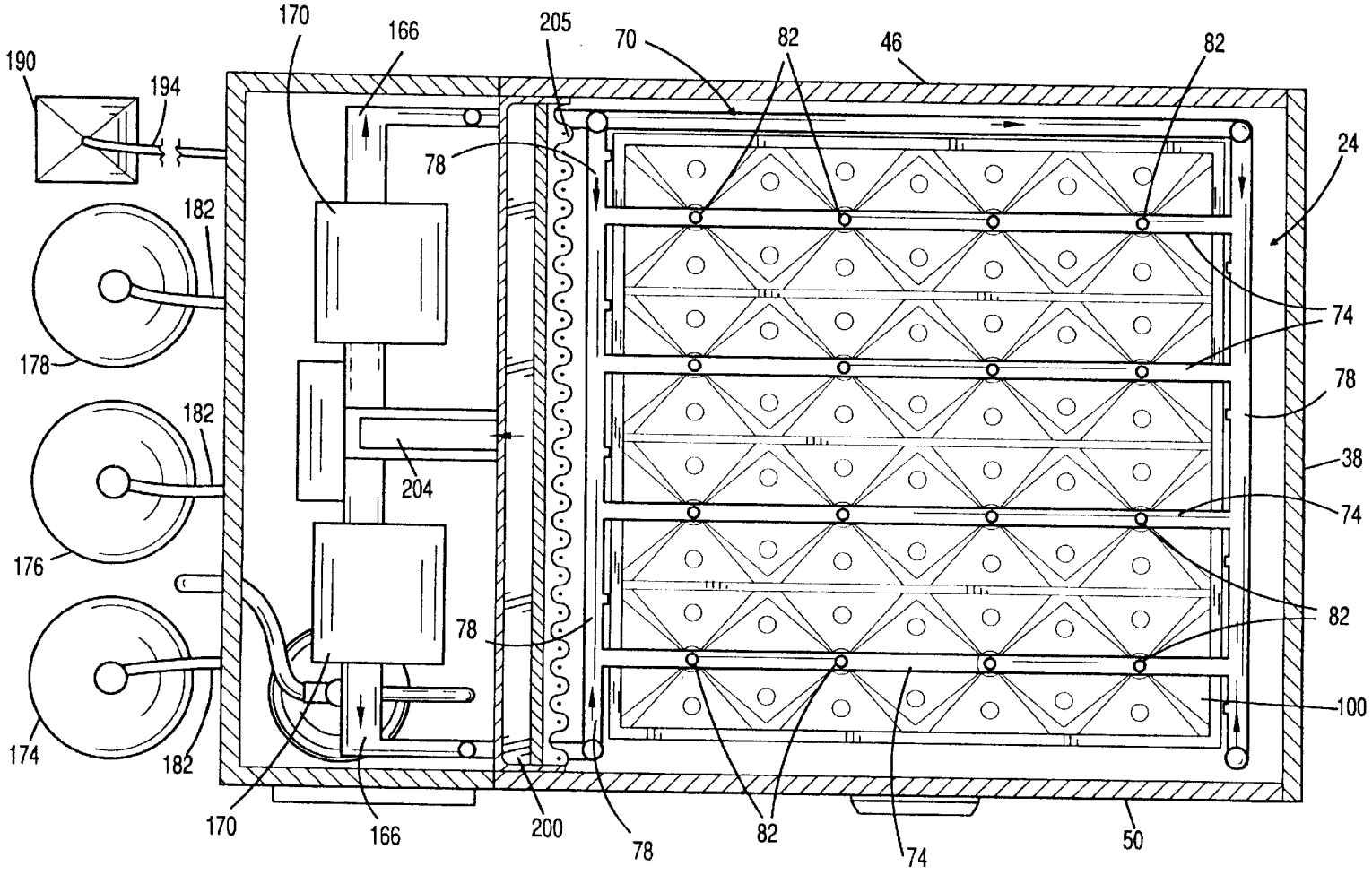
Figure 5:
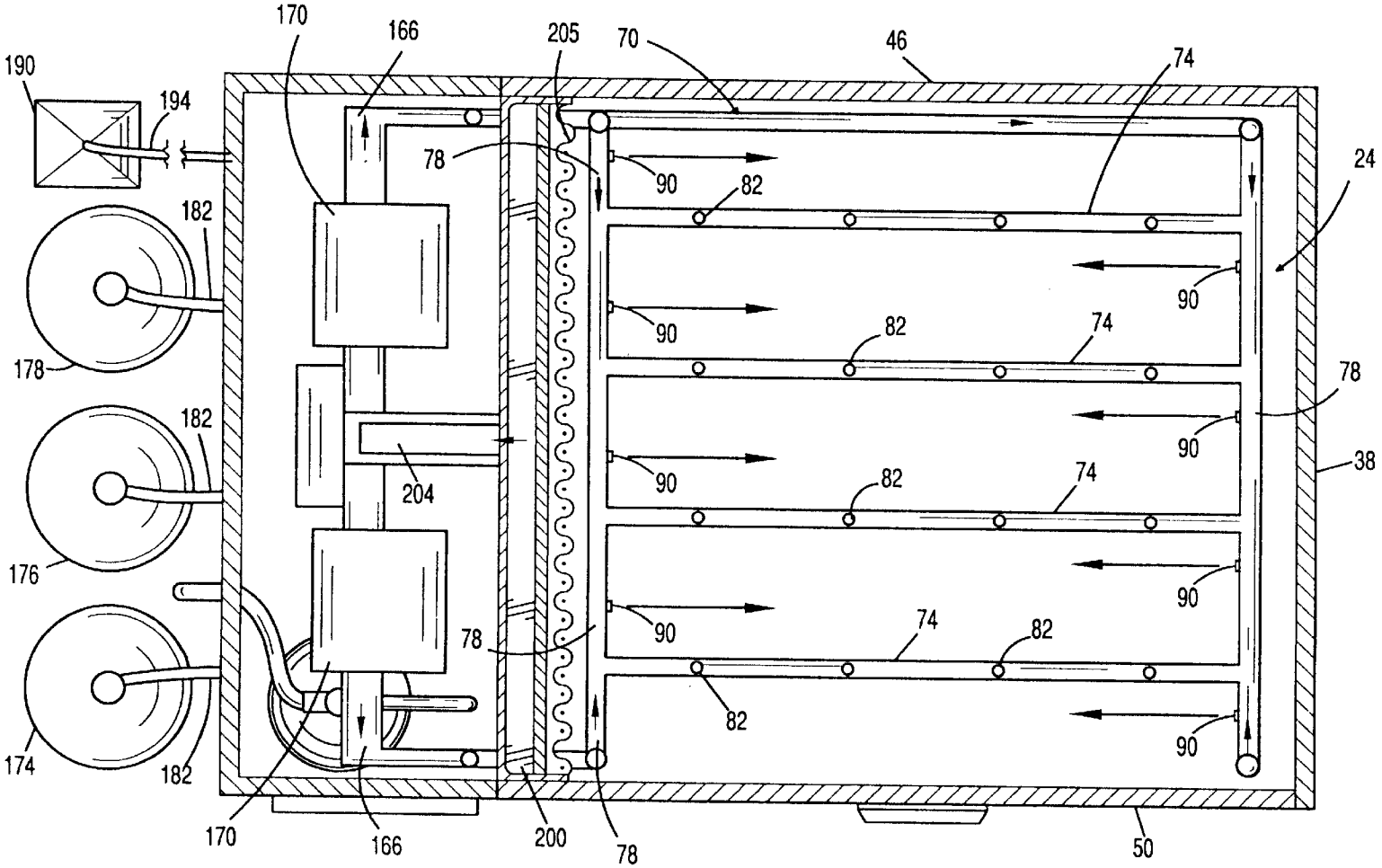
FIG. 5 is a cross section of FIG. 4, with the trays removed.

A washing and chilling apparatus 20 is shown in FIGS. 1–6. The apparatus 20 is suitable for use with any materials that are capable of being chilled, such as glass, ceramics, plastics and metals. The apparatus 20 includes a washing compartment 24, which is enclosed by a top wall 28, side walls 38 and 42, rear wall 46, front wall 50 and bottom wall 54. Suitable structure such as the door 58 provides access to the washing compartment 24.

A fluid supply manifold 70 is provided in the wash compartment 24 in order to supply liquids to the washing compartment 24. The manifold 70 provides a number of fluid conduits and fluid outlets for supplying fluids to the washing compartment 24. The manifold 70 can have any construction suitable for this purpose. The manifold 70 preferably connects to one or more substantially vertically spraying branches 74 and to one or more substantially horizontally spraying branches 78. The vertically spraying branches 74 and horizontally spraying branches 78 can be in fluid communication with each other. The vertically spraying branches 74 have upward spraying outlets 82 and downward spraying outlets 86. Separate branches can alternatively be provided for the upward spraying outlets 82 and the downward spraying outlets 86. The vertically spraying branches 74 are preferably provided in spaced relation so as to cover the area of the tray 100 and to position the upward spraying outlets 82 below the position of articles in the tray 100, and to position the downward spraying outlets 86 above the position of articles in the tray 100. The horizontally spraying branches 78 are preferably provided at ends of the wash compartment 24, so as to spray fluid inwardly toward articles in a horizontal direction through outlets 90. The spraying branches 74 and 78 can be provided in stacked relation within the washing compartment 24, in order to provide for the washing of several trays of articles stacked in the washing compartment 24, as depicted particularly in FIG. 6.

Figure 13:
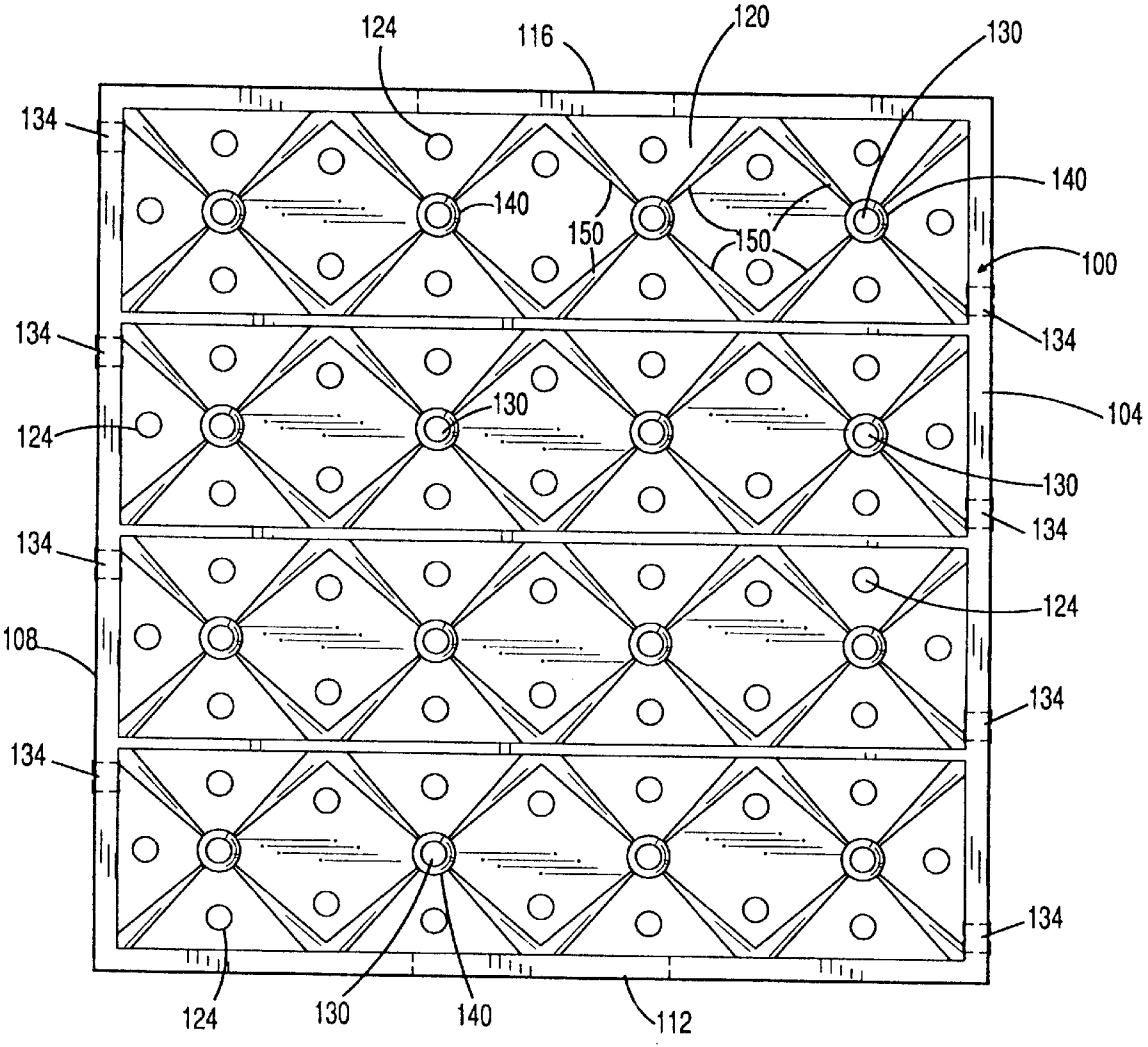
FIG. 13 is a top plan view of a tray according to the invention.
Figure 15:
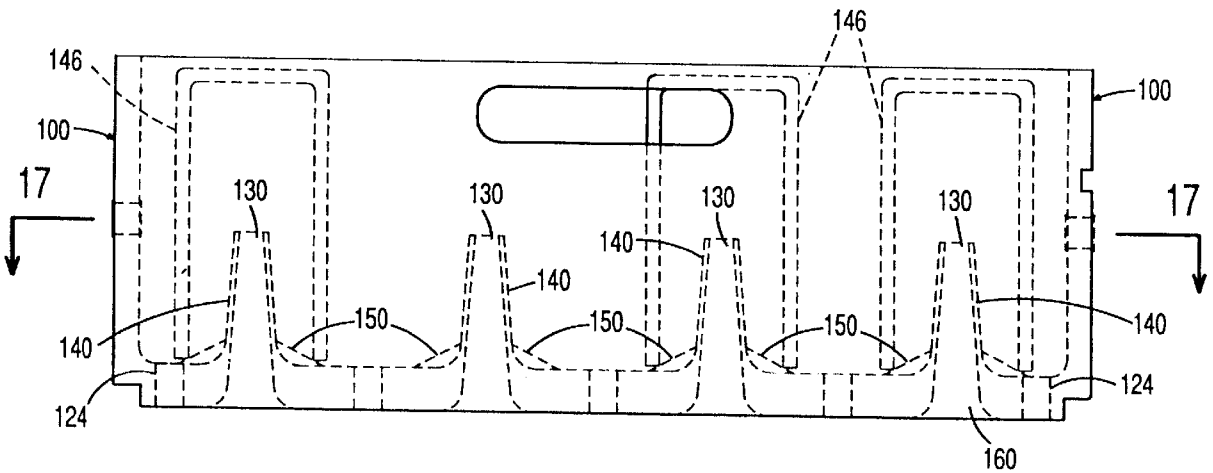
FIG. 15 is a front elevation of tray partially cut away and partially in phantom.
Figure 16:
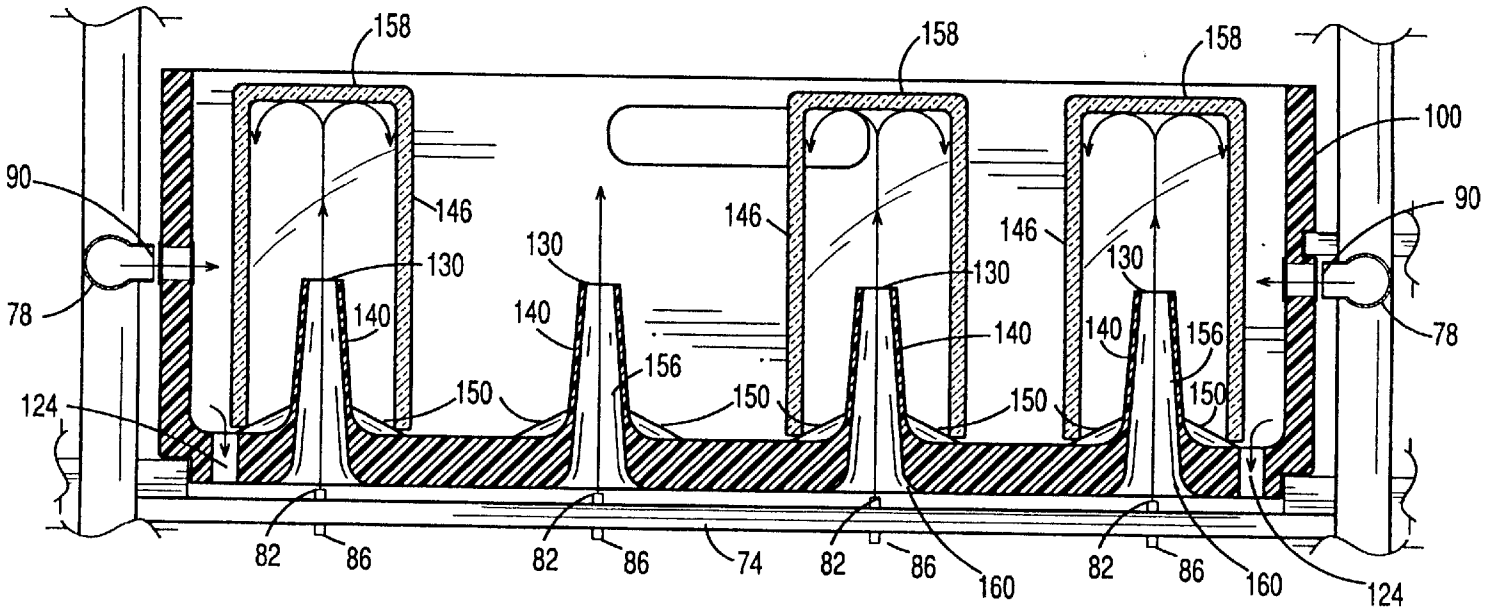
FIG. 16 is a cross section taken along line 16—16 in FIG. 14.
Figure 17:
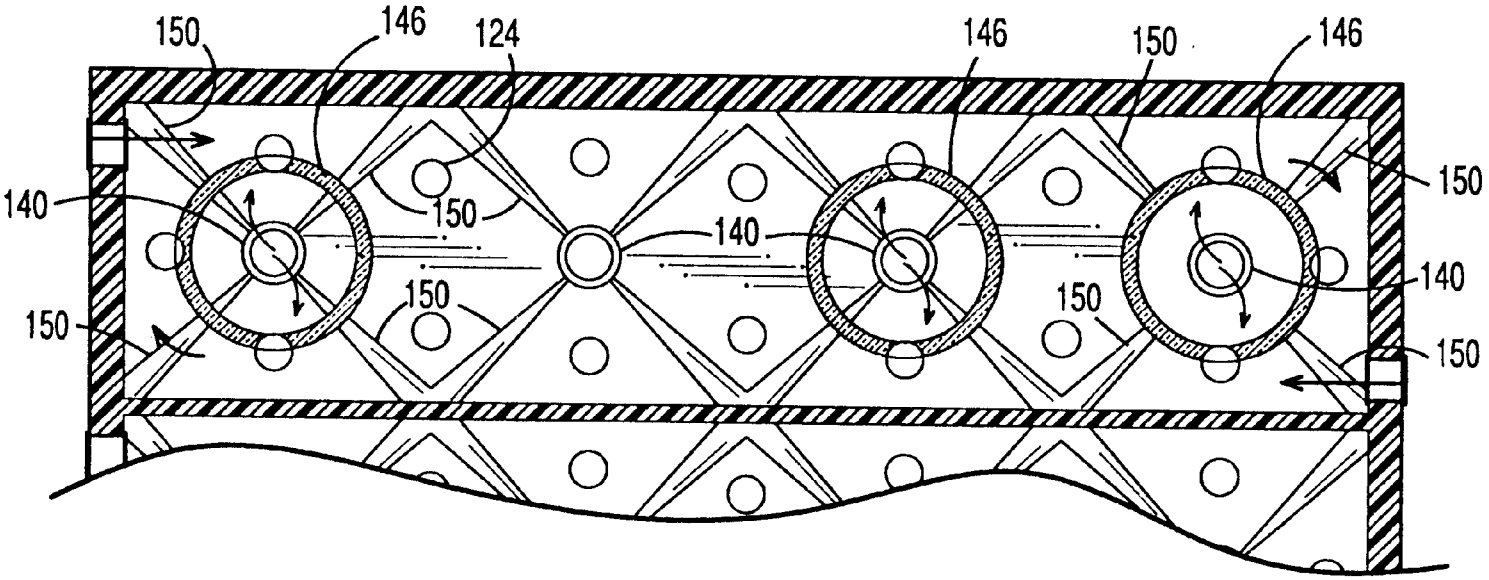
FIG. 17 is a cross section taken along line 17—17 in FIG. 15.
Figure 18:
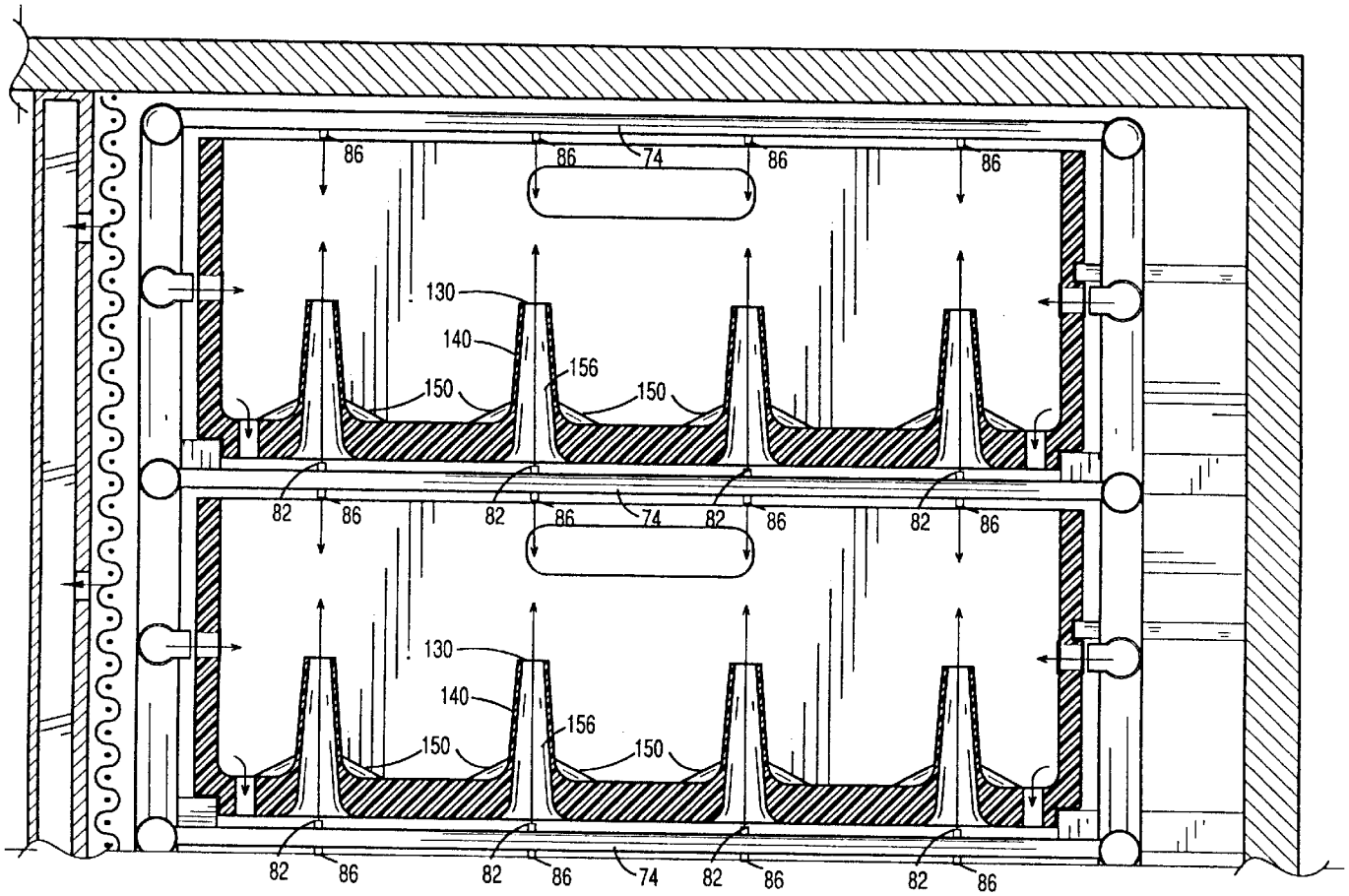
FIG. 18 is a cross section taken along line 18—18 in FIG. 4.

The tray 100 is shown in FIG. 13. The tray includes side walls 104 and 108, front wall 112 and rear wall 116. Bottom 120 has a plurality of drain openings 124 from which fluids, and particularly gassy liquids, can drain from the tray 100. The bottom 120 also includes a plurality of fluid directing openings, such as the bottom openings 130 and side openings 134. The bottom openings 130 are preferably provided at the vertex of upwardly extending nozzles 140. The nozzles 140 serve as a positioning guide on which to place articles 146 to keep the articles 146 over the bottom openings 130, as shown in FIGS. 15–16. Inclined surfaces 150 surrounding each nozzle 140 can be provided to assist in centering the articles 146 over the nozzle 140, and serve as structural elements for the tray 100.

Figure 14:
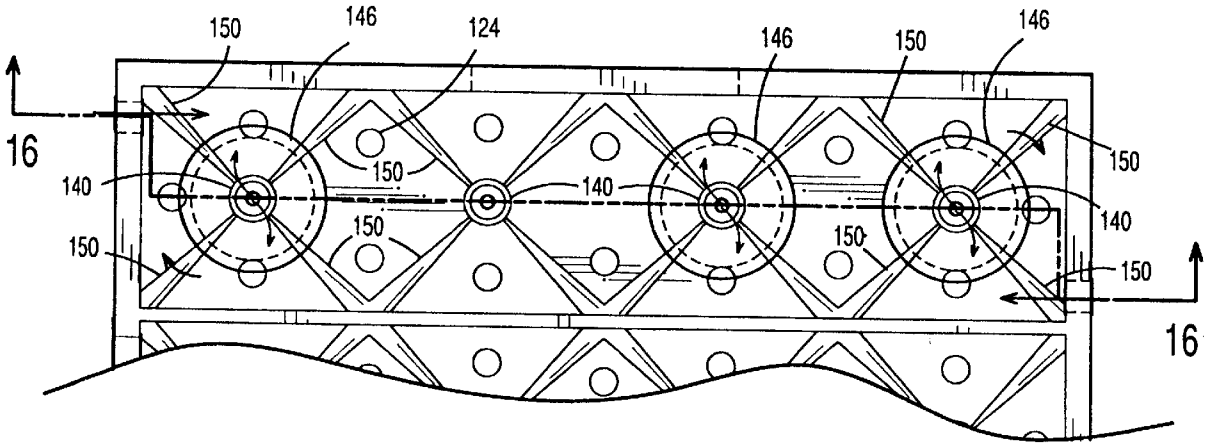
FIG. 14 is a top plan view, partially cut away and partially in phantom, illustrating the tray as positioned in a washer compartment with some articles in place.

As shown in FIG. 16, each nozzle 140 preferably has a substantially conical open interior 156, which serves to collect fluids fed to the base 160 of the nozzle 140 from the upward spraying outlet 82, and to direct these fluids through the bottom openings 130 in a manner depicted by the arrows in FIG. 16. Fluids thereby thoroughly coat the inside of the articles 146. Similarly, the downward spraying outlets 86 spray fluid downwardly onto the bottoms 158 of the inverted articles 146. Horizontally spraying outlets 90 in the horizontally spraying branches 78 are aligned with side openings 160 in the tray 100, such that the fluid from the outlets 90 is directed tangentially against the sides of the articles 146. This creates a cyclonic motion of the fluid around each of the articles 146, as shown in FIG. 14.

Figure 6:
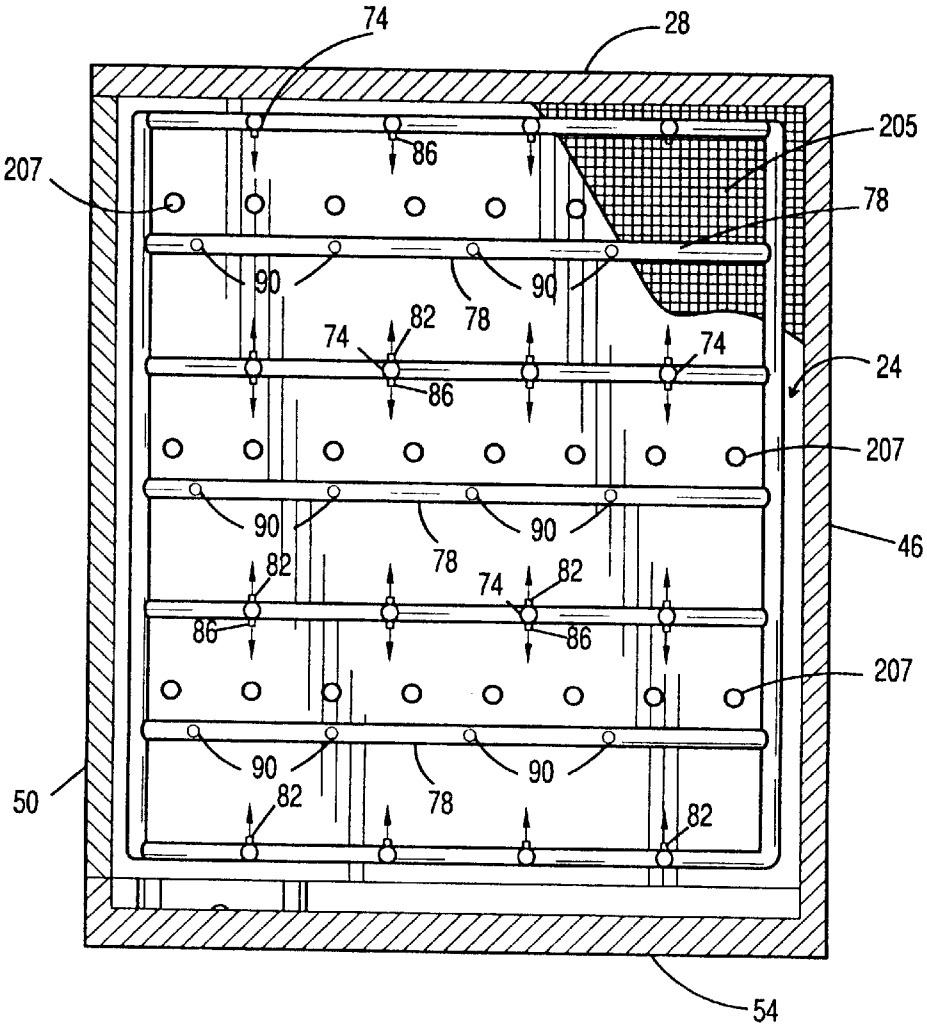
FIG. 6 is a cross section taken along line 6—6 in FIG. 2.
Figure 7:
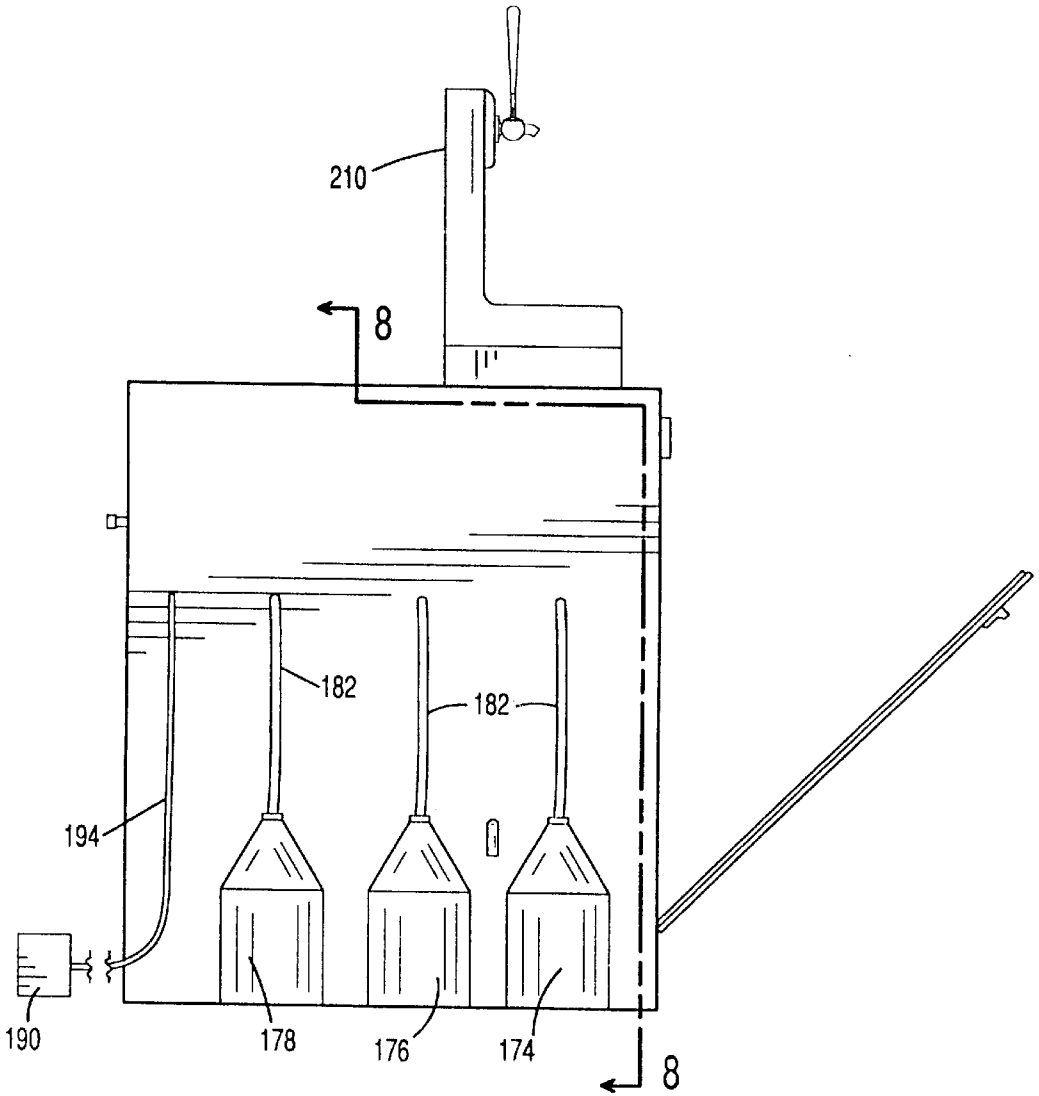
FIG. 7 is a left side elevation of an alternative embodiment.

The number of vertically spraying branches 74 that are necessary will be dependent on the size of the tray 100 and the number of articles that are to be washed. In general, one upward spraying outlet 82 is preferred for each article that will be washed. As an example, the tray 100, as shown in FIG. 13, is intended to hold 16 articles, and has a nozzle 140 for each such article. The vertically spraying branches 74 are provided in spaced relation within the washing compartment 24 such that when the tray 100 is inserted into the washing compartment 24, the upward spraying outlets 82 will be positioned below the nozzles 140, and the downward spraying outlets 86 will be positioned over the bottoms 158 of the inverted articles 146. Accordingly, four spaced vertically spraying branches 74 are present for each tray 100 shown in FIG. 13, however, it will be appreciated that trays capable of holding more or fewer articles 146 are possible, and more or fewer upward spraying outlets 82 and vertically spraying branches 74 would be acceptable. It is preferred that several trays 100 be stacked within the washing compartment 24. Accordingly, the vertically spraying branches 74 are provided spaced apart and in rows, with one row positioned over the other, as shown in FIG. 6. The trays 100 are inserted between the rows. Downward spraying outlets 86 are positioned to direct fluid onto the bottoms 158 of the articles 146 when the trays 100 are inserted into the washing compartment 24.

Suitable manifold structure is preferably provided to connect vertically spraying branches 74 and the horizontally spraying branches 78 to sources for the necessary fluids. The nozzles 140 with fluid directing openings 130, and side openings 160 illustrate one embodiment of a feature of the invention in which a tray for a washing apparatus is provided with fluid-directing outlets which communicate with fluid sources. In the embodiment illustrated, the nozzles 140 receive fluid from the outlets 82 and the openings 160 receive fluid from the outlets 90. The invention is not limited in this regard, however, as other fluid directing structure can be provided in the tray along with suitable means for connecting this structure to fluid supply sources. The present structure has an advantage in that no connection is necessary between the tray and the fluid supply. The positioning of the tray 100 in the washing compartment 24 positions the nozzles 140 over the outlets 82, owing to the dimensions of the tray 100 and the position of the vertically spraying branches 74 within the washing compartment 24.

The branches 74 and 78 are preferably connected by a manifold 166 to the fluid supply sources. Suitable air or gas supply apparatus, such as the centrifugal blowers 170, can be provided to drive the fluids through the manifold 166, branches 74 and 78 and into the washing compartment 24. Fluids can be stored in any suitable compartment or container. There are shown in the drawings containers 174,176, and 178. The container 174 can be used to store a rinse aid. The container 176 can be used to a supply sanitizer solution. The container 178 can provide a detergent. Supply lines 182 can transport the solutions from the containers 174, 176, and 178 to metering pumps 175, 177, and 179. Switching valves 184 can control the flow of fluids from the various metering pumps to the manifold 166, in order to supply the necessary compounds at the appropriate time of the operation of the apparatus.

Another container 190 can be used to provide a supply of coolant, such as liquid nitrogen, through a supply line 194. Other coolants, such as $CO_2$, liquid air, and the combination of air and liquid nitrogen, are possible. The container 190 can be placed in a location that is remote from the apparatus 20. In such an arrangement, the supply line 194 can transport the coolant from the container 190.

An exhaust manifold 200 can be provided in the washing compartment 24 in order to exhaust gas and vapor from the washing compartment 24. The exhaust manifold 200 can have a mesh cover 205 mist eliminator to collect liquid from the recirculating air. The recirculating air can then pass through one of a plurality of openings 207 into the manifold 200. A return line 204 returns the gas and vapor to the centrifugal circulation blowers 170, which recirculates the gas through the manifold 166. Liquid accumulating at the bottom of the washing compartment 24 is collected by the sloped floor 54 and returned by the sump pump 169 to the manifold 166 or passed to a drain 171.

In operation, the wash cycle can be initiated by operation of an on switch in a suitable controller. The switch can open a solenoid valve 183 connected to a domestic hot water supply. The liquid can flow into the wash compartment 24 by way of the manifold 166. A liquid level sensor 181 can detect that the sump is full. The hot water solenoid valve 183 can close, and the centrifugal circulation blowers 170, the sump pump 169, and the detergent metering pump 175 can be energized. The diverting valve 187 can direct flow from the sump pump to the manifold 166. A predetermined quantity of detergent can be pumped from the detergent container 174 into the manifold, as the centrifugal blower 170 circulates the hot water and detergent through the manifold 166 and the branches 74 and 78. The detergent can flow through the outlets 82, 86 and 90 and circulate around the articles 146, to thoroughly wash the articles 146, both inside and out. When the wash cycle times out, the diverting valve 187 can direct flow to the drain 171. The liquid level sensor 193 can monitor the level in the sump and signals the controller when the sump is empty. The controller can then initiate the sanitizing cycle. The solenoid valve 191 can open to allow cold water to enter the sump by way of the manifold 166. The diverting valve 187 can switch to direct flow valve to the manifold 166. The sump pump 169 can be energized to begin circulating cold water through the manifold 166 and branches 74 and 78. The sanitizing metering pump 177 can be energized and provide a predetermined amount of sanitizing solution from the container 176 and provide a predetermined amount of sanitizing solution to the manifold, which can be circulated through the manifold 166 and into the washing compartment 24.

When the sanitizing rinse cycle times out, water can return to the sump, and the sanitizing fluid can be pumped to the waste drain. The liquid level sensor can monitor the level in the sump, and signal the controller when the sump is empty. The controller can then initiate the cold water rinse cycle. The solenoid valve 191 can open to allow cold water to enter the sump. The directing valve 187 can switch to direct flow back to the manifold. The main circulating pump can be energized, to begin circulating the cold water through the branches 74 and 78. The rinse aid metering pump can be energized and provide a predetermined amount of rinse aid solution from the container 178 to the cold water in the manifold, which can be distributed through the manifold 166 into the washing compartment 24.

When the rinse cycle times out, the water can return to the sump and can be pumped to the waste drain. The liquid level sensor can monitor the level in the sump and signal the controller when the sump is empty. The blower 170 can continue to operate to purge any liquid from the manifold system. The controller can then initiate the freeze cycle. The solenoid valve 201 can open to allow liquid nitrogen to flow from the container 190, through the manifold 166, and can be injected with air to circulate about the articles 146 and to thereby frost water and other matter remaining on the articles from the rinse cycle. When the freeze cycle times out, the liquid solenoid valve 201 can close.

A temperature indicator can be provided to indicate the temperature of the washing compartment 24. An indicator on the control panel, such as an icon, can indicate that the freeze cycle is completed and preferably sounds an audible signal. The signal can be acknowledged by pushing a "Cancel" icon on the control panel, after which the apparatus can enter a "Stand-By" mode. The temperature of the compartment can be monitored. When the temperature exceeds a programmable set point, the liquid nitrogen solenoid valve can open and allow liquid nitrogen to flow for a programmable period of time, or until the temperature set point is reached. This cycle can repeat until the door of the washing compartment is opened; when the door is opened, the machine can be de-energized.

The timing of the various cycles is subject to variation. The controller can be programmable, such as the various cycle times can be modified by the user. A currently preferred cycle time schedule, together with desired temperatures, is provided in FIG. 19. The wash cycle preferably operates for a maximum of about one minute, with temperatures of at least 120° F. The sanitizing cycle operates for at least about ½ minute, with temperatures of at least about 75° F. The rinse cycle operates for about 1 minute and at temperatures of about 75° F. The freeze cycle operates for about 1 minute and at temperatures below at least about 23° F. The total cycle time is, therefore, approximately 3-½ minutes, which permits the rapid cycling of glasses through the apparatus, to provide a steady supply of clean, frosted glasses. The timing required for each cycle is minimized by the nature of the cyclonic motion of fluids in the washing compartment. It is understood that the invention is not limited to these cycle and cycle times.

Figure 8:
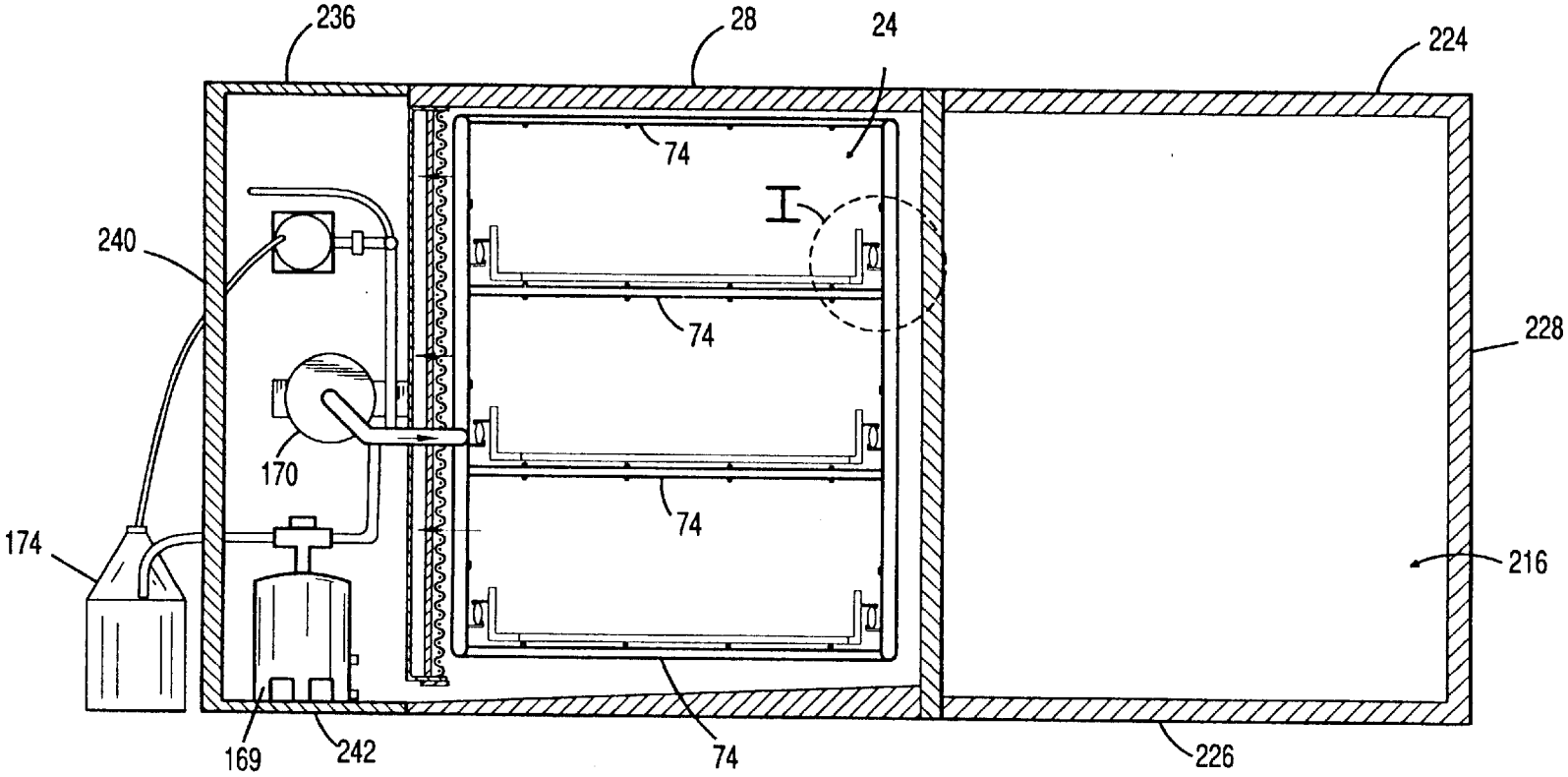
FIG. 8 is a cross section taken along line 8—8 in FIG. 7.

The apparatus of the invention can be provided in different forms. FIGS. 7–11 shown an alternative embodiment of the invention in which the apparatus is formed integrally with a beverage tap 210. The beverage tap 210 is connected by suitable connecting conduits to beverage supply containers (not shown). In this manner, the washing and chilling apparatus of the invention can be provided at beverage service locations where space is at a premium. Further, a cold storage compartment 216 can be provided in which to store frosted articles 146 which have been processed through the washing compartment 24, as shown in FIG. 8. The cold storage compartment 216 can be fashioned to the side of the washing compartment 24 with top wall 224, bottom wall 226 and side wall 228. The cold storage compartment 216 can be maintained at a desired temperature by conventional refrigeration apparatus, or by a cryogenic fluid such as liquid nitrogen from the container 190, in order to maintain the desired temperature. Proper cycling of the liquid nitrogen into the cold storage container can be accomplished by suitable temperature sensor, control valve, and gas supply structure. The cold storage compartment 216 can be accessed by a suitable door 230.

Figure 11:
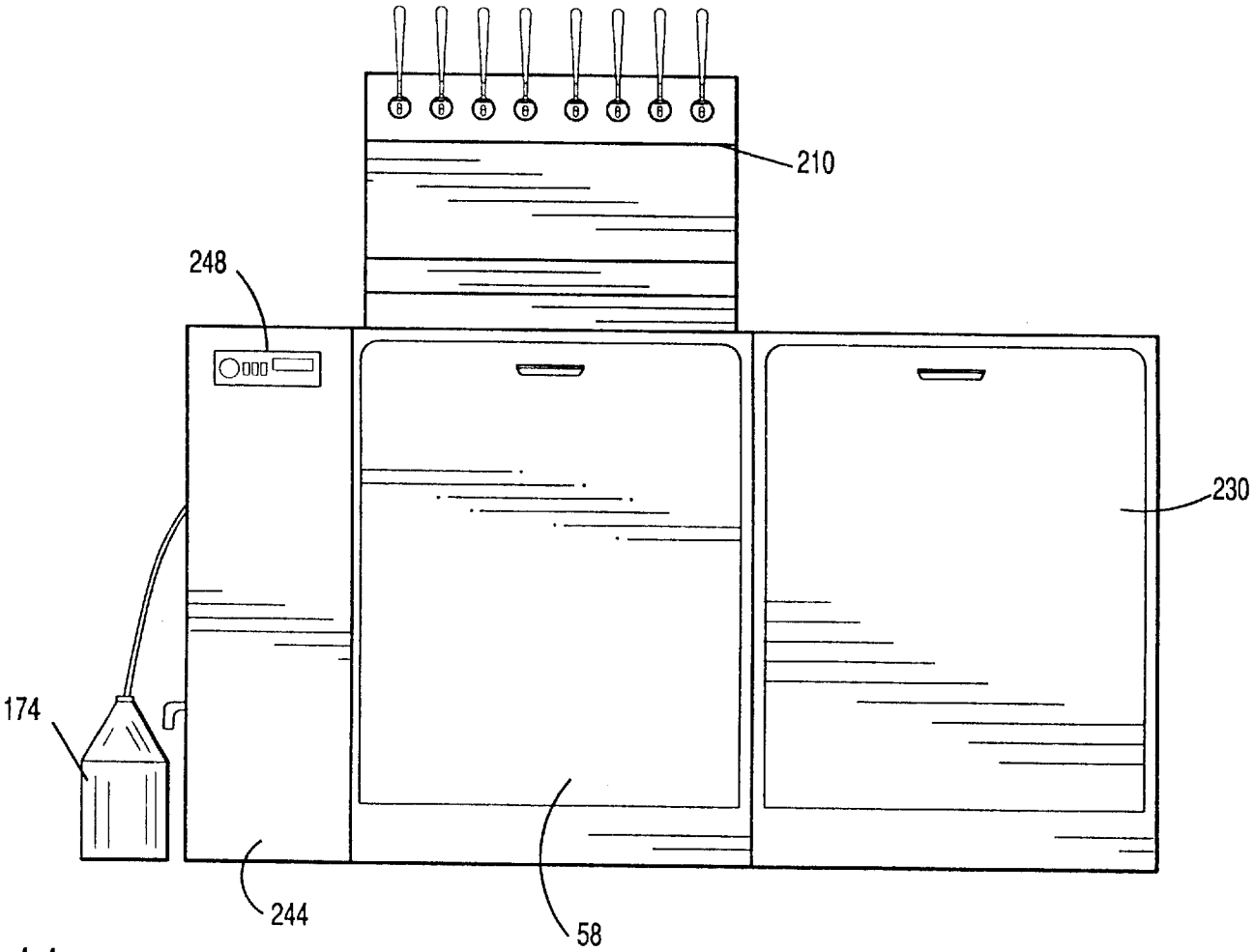
FIG. 11 is a front elevation of an alternative embodiment.

The recirculation blowers 170 are preferably located in a protective cabinet. The cabinet can be fashioned from walls 236, 240, 242, and 244. As shown in FIG. 11, the control panel 248 can be provided in one of the walls, such as the front wall in order to provide ready access and connections to the circulation pumps, solenoid valves and the like.

Figure 9:
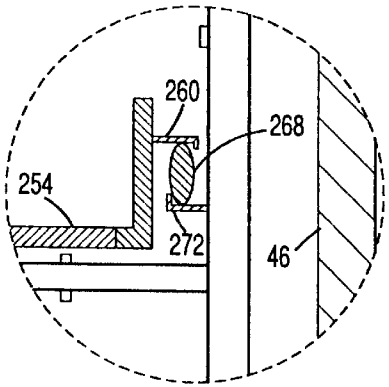
FIG. 9 is a magnified view of area I in FIG. 8.
Figure 10:
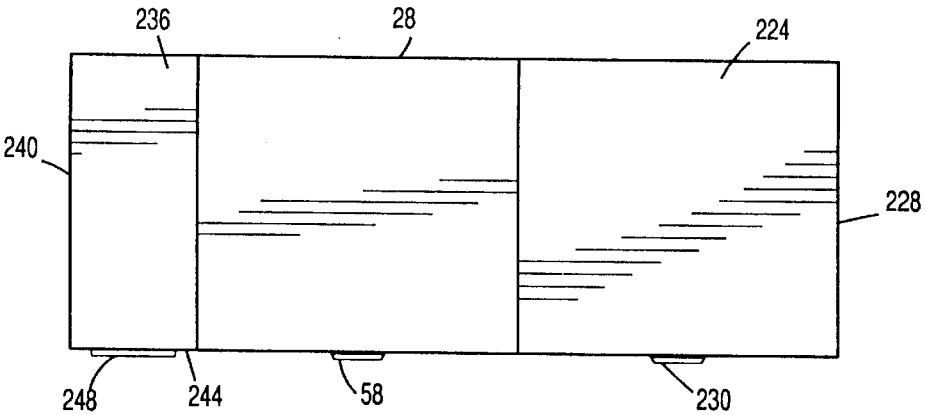
FIG. 10 is a top plan view of an alternative embodiment.
Figure 12:
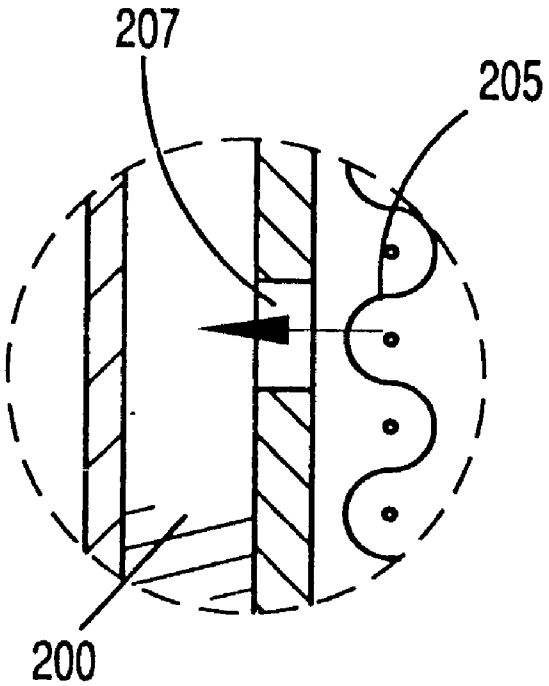
FIG. 12 is a magnified view of the area II in FIG. 4.

The manner in which the trays 100 are positioned in the washing compartment 24 is capable of variation. It is preferable that movable drawers are provided in order to facilitate the placement of the trays 100 into and out of the washing compartment 24. The slides for the trays need to support the weight of a filled tray when pulled out of the washing compartment. There is shown in FIG. 9 drawers structure which is suitable, however, the invention is not limited in this regard. The drawers 254 can have support flanges 260 which rest on casters 268. The casters 268 can rest on a base flange 272, which is connected to the walls of the washing compartment 24, such as the wall 46 shown in FIGS. 9 and 12. The drawers 254 can be pulled out of the washing compartment 24 to allow the placement of a tray 100 on the drawer 254. The tray 100 and drawer 254 can then be pushed into the washing compartment. It is important that the tray 100 and drawer 254 are suitably dimensioned and positioned such that the nozzles 140 are positioned over the outlets 82 when the drawer and tray are inserted into the washing compartment 24. The drawer 254 should have openings which coincide with the outlets 82 and nozzles 140 so as to permit the flow fluid from the outlets 82 into the nozzles 140. Also, the positioning of the trays preferably properly align the openings 160 and the sides of the trays with the outlets 90. Alternatively, the washing compartment can be provided with a frame upon which the frame rests.

The shape and configuration of the trays and nozzles may be altered for washing and chilling any suitable item. For example, nozzles which are thinner than those shown in the illustrated embodiments may be provided for use with test tubes, while shorter nozzles may be provided for use with bowls, trays, petri dishes and similar articles. The nozzles may be adapted to issue a jet of fluid horizontally in order to wash articles such as plates, serving trays and pasta bowls.

For medical equipment and laboratory equipment, it may be desirable to provide a small washing and chilling apparatus capable of washing and chilling only one or two articles at a time. For example, a washing and chilling apparatus may be provided at or close to an operating area or blood donation center so that, for example, trays for the receipt of organs or plastic packs of donated blood may be chilled immediately prior to use so that the organ or donated blood may start being chilled by the tray as it is being transported to the usual chilled storage facility or transport container. For medical, laboratory or other sterile use, the washing step and/or apparatus may be modified, for example by the use of higher water temperatures and longer washing times from the described embodiments, in order to maintain sterility of the articles.

What is claimed is:

1. An apparatus for washing articles, comprising:

a washing compartment having a plurality of fluid outlets;

at least one tray for retaining the articles, said tray being positionable in said washing compartment and having fluid directing nozzles alignable with at least one of said outlets in said washing compartment to permit fluid to flow from said nozzles through said tray and to direct said fluid into contact with the articles.

2. The apparatus of claim 1, wherein said outlets comprise substantially upward spraying outlets, substantially downward spraying outlets and substantially horizontally spraying outlets.

3. The apparatus of claim 2, wherein said outlets are in fluid communication with at least one manifold, said manifold being in communication with a fluid source.

4. The apparatus of claim 3, further comprising at least one blower for blowing a gas through said manifold and said outlets.

5. The apparatus of claim 4, further comprising at least one liquid pump for injecting at least one liquid into said manifold, whereby the liquid will be carried by the gas through said nozzles and into contact with the articles.

6. The apparatus of claim 5, further comprising at least one exhaust manifold for removing exhaust gas from said washing compartment.

7. The apparatus of claim 6, further comprising a mist eliminator to collect liquid from recirculating gas.

8. The apparatus of claim 1, wherein said tray includes a floor and said fluid directing nozzles extend upwardly from said floor, whereby the articles can be positioned over said fluid directing nozzles and said fluid directing nozzles will direct gas into the articles.

9. The apparatus of claim 8, wherein at least a portion of said outlet and said opening are directed so as to cause substantially tangential contact of the gas with the articles.

10. The apparatus of claim 1, wherein a plurality of said nozzles are connected to a manifold, and further comprising at least one liquid storage compartment and at least one pump for transporting liquid from said liquid storage compartment.

11. The apparatus of claim 10, further comprising valves to control fluid flow from said storage compartments into said manifold.

12. The apparatus of claim 11, further comprising connection means for connecting said manifold to hot and cold water supplies and valve means for controlling the flow of fluid from each of said supplies into said manifold.

13. The apparatus of claim 12, wherein said valves are solenoid valves and are controlled by control apparatus.

14. The apparatus of claim 13, further comprising a chilling fluid supply, and control structure for directing said chilling fluid into said manifold.

15. A method of washing articles, comprising the steps of:

providing a washing compartment having a plurality of fluid outlets;

positioning the articles on a tray that is positioned in the washing compartment, the tray having a plurality of fluid directing openings aligning with at least one of the fluid outlets;

transporting a washing fluid to the outlets, whereby the fluid will be directed into the fluid directing nozzles, and the fluid directing nozzles will direct the fluid into contact with the articles.

16. The method of claim 15, wherein at least a portion of the fluid is caused to contact the articles substantially tangentially.

17. The method of claim 16, wherein the tray comprises a bottom, and at least one of the fluid directing nozzles extends upwardly from the floor, fluid leaving the nozzle being directed into articles positioned over the nozzle.

18. The method of claim 15, wherein a washing fluid, rinsing fluid, and cooling fluid are sequentially passed through the outlet.

19. The method of claim 15, further comprising the step of exhausting the fluid from the washing compartment through at least one exhaust outlet.

20. The method of claim 15, wherein said fluid comprises air into which a liquid has been injected.

21. A tray for washing articles, comprising a floor and side walls, and at least one opening through said floor having a fluid-directing nozzle, whereby fluid injected into said opening will be directed by said nozzle into contact with the articles.

* * * * *